US005165607A

United States Patent [19]

Stevens

[11] Patent Number: 5,165,607

[45] Date of Patent: Nov. 24, 1992

[54] FUEL INJECTION NOZZLE

[75] Inventor: John W. Stevens, Kent, England

[73] Assignee: Lucas Industries public limited co., England

[21] Appl. No.: 704,279

[22] Filed: May 22, 1991

[30] Foreign Application Priority Data

Jun. 1, 1990 [GB] United Kingdom ..... 9012288

[51] Int. Cl.[5] ..... F02M 45/08; F02M 61/20

[52] U.S. Cl. ..... 239/533.4; 239/533.9

[58] Field of Search ..... 239/533.3-533.6, 239/533.9, 533.11, 533.12

[56] References Cited

U.S. PATENT DOCUMENTS 4,768,719 9/1988 Straubel et al. ..... 239/533.4
4,848,668 7/1989 Andrews et al. ..... 239/533.9
4,962,890 10/1990 Shindo et al. ..... 239/533.9

FOREIGN PATENT DOCUMENTS 0030975 2/1990 Japan ..... 239/533.6
2188367 9/1987 United Kingdom .

*Primary Examiner*—Andres Kashnikow
*Assistant Examiner*—Karen B. Merritt
*Attorney, Agent, or Firm*—Andrus, Sceales, Starke & Sawall

[57] ABSTRACT

A fuel injection nozzle of the two stage lift type has a nozzle body containing the valve member of the nozzle and a holder which are spaced apart by a distance piece. A first spring acts on the valve member and a second spring is operative on the valve member after the latter has moved a predetermined distance away from the valve seating. The second spring is engaged by a spring abutment which in the closed position of the valve member engages the adjacent face of the distance piece and the end of the valve member lies flush with the valve body. A push piece is interposed between the valve member and the spring abutment and the extent of movement of the valve member before the second spring is brought into operation is determined by maching the push piece and/or the distance piece.

4 Claims, 2 Drawing Sheets

FUEL INJECTION NOZZLE

BACKGROUND OF THE INVENTION

This invention relates to a fuel injection nozzle for supplying fuel to an internal combustion engine, the nozzle comprising a nozzle body defining at one end a mounting face, a blind bore extending inwardly from the mounting face towards the other end of the body, a seating defined in the bore, a valve member slidable in the bore and engagable in its closed position with the seating to prevent flow of fuel from a nozzle inlet through an outlet, the valve member being movable by fuel under pressure supplied to the inlet away from said seating to allow fuel flow through the outlet, a nozzle holder, a distance piece interposed between an end face of the holder and said mounting face, means securing the nozzle holder, the distance piece and the nozzle body in assembled relationship, a first spring housed within a chamber defined in the holder, the first spring acting through a rod to urge the valve member into contact with the seating, a second spring housed within the chamber, a spring abutment engaged with one end of said second spring and a push-piece located between the valve member and said spring abutment, said valve member being initially moved by the fuel pressure against the action of the first spring to allow a restricted flow of fuel through the outlet and after a predetermined movement, against the action of both springs to allow an increased rate of flow of fuel through the outlet.

Such nozzles are well known in the art and provide what is known as two-stage lift of the valve member. The initial stage of lift may be as low as 0.06 mm and in order to achieve the desired purpose ie a reduction in the rate of rise of pressure in the engine cylinder by restricting the rate of fuel delivery, it is necessary that the initial stage of lift should be carefully controlled.

One example of such a nozzle is seen in U.S. Pat. No. 4,768,719 in which the push-piece is in the form of a flanged bush which is housed in a stepped bore in the distance piece. The spring abutment engages the bush and urges it into contact with the mounting face of the nozzle body and the bush is engaged by the valve member at the end of said predetermined movement. In the closed position of the valve member the end of the valve member therefore has to lie a distance below the level of said mounting face corresponding to said predetermined movement and it is not particularly easy to machine the valve member to the high degree of accuracy required.

Another example of such a nozzle is seen in GB No. 2188367 in which the end face of the valve member again lies below the mounting face of the nozzle body in the closed position of the valve member. In this example however the spring abutment does engage the end face of the distance piece which is presented to the aforesaid end face of the holder thereby making it easier to adjust the pre-load of the second spring.

SUMMARY OF THE INVENTION

The object of the present invention is to provide a fuel injection nozzle of the kind specified in a simple and convenient form.

According to the invention in a fuel injection nozzle of the kind specified said push-piece comprises a flanged sleeve which is housed in a stepped bore in the distance piece and in the closed position of the valve member the surface of the valve member which engages said sleeve lies flush with said mounting face and the spring abutment engages the end face of the distance piece which is presented to said end face of the holder, whereby the setting of said predetermined movement can be determined by machining the distance piece and/or the push-piece.

DESCRIPTION OF THE DRAWINGS

An example of a fuel injection nozzle in accordance with the invention will now be described with reference to the accompanying drawings in which.

DETAILED DESCRIPTION OF THE PREFERRED EMBODIMENT

Figure 1:
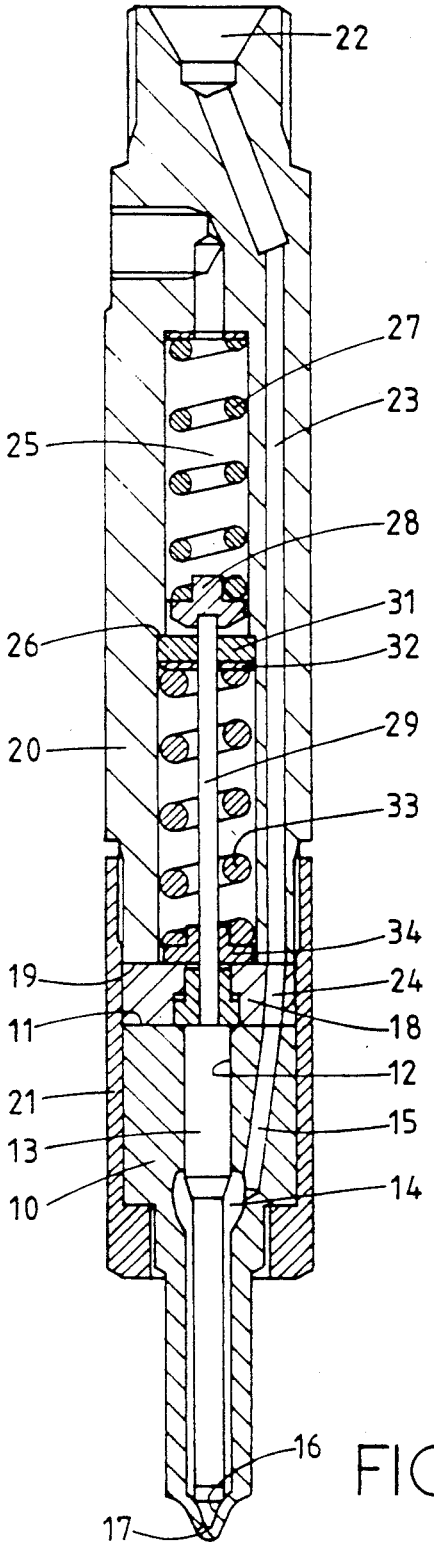
FIG. 1 shows a sectional side elevation of the nozzle

Referring to FIG. 1 of the drawings the nozzle comprises a stepped nozzle body 10 having at one end a mounting face 11. Extending inwardly from the mounting face towards the narrower end of the nozzle body is a bore 12 in which is slidable a stepped valve member 13. The bore 12 intermediate its ends is provided with an enlargement 14 which communicates with one end of an inlet passage 15 opening onto said mounting face. The bore defines a seating 16 and the valve member is shaped for co-operation with the seating and in the closed position engages with the seating to prevent flow of fuel through an outlet orifice 17 located downstream of the seating.

Located against the mounting face is a cylindrical distance piece 18 and this in turn engages the end face 19 of a nozzle holder 20, the holder, distance piece and nozzle body being held in assembled relationship by means of a cap nut 21. The holder at its end remote from the nozzle body defines a fuel inlet 22 which is connected by passages 23 and 24 in the holder and distance piece respectively, with the inlet passage 15.

The holder defines a vented chamber 25 which intermediate its ends is formed with a step 26.

Figure 3:
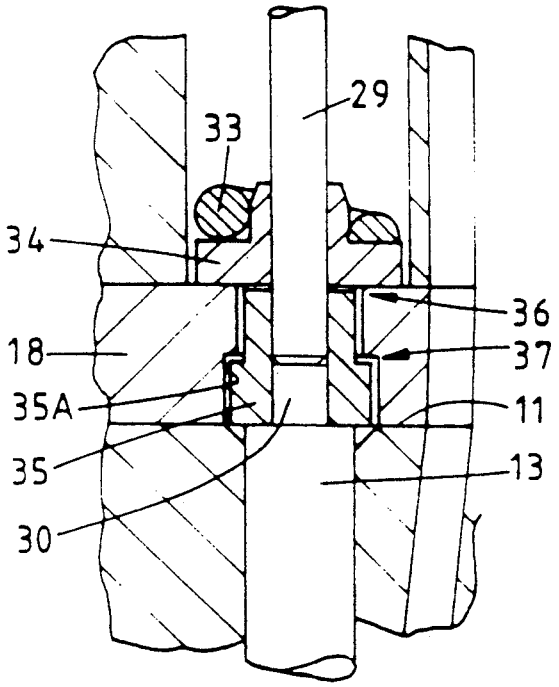

Located in the end portion of the chamber 25 remote from the nozzle body is a first spring 27 one end of which bears against a shim which in turn engages the end wall of the chamber remote from the nozzle body. The other end of the spring 27 is engaged with a first spring abutment 28 having a recess formed in its face remote from the spring. Located in the recess is one end of a rod 29, the other end of which engages the end face of the valve member remote from the outlet orifice 17 or, as shown in FIG. 3, engages a short extension 30 on said end face of the valve member. The rod 29 extends through and is guided by the wall of an aperture in an abutment plate 31 which is located against the step 26. The rod in turn guides the movement of the abutment 28. The abutment plate is engaged by a shim 32 which is interposed between the abutment plate and one end of a second coiled compression spring 33. The other end of the spring 33 engages an annular spring abutment 34 through which the rod 29 passes. The spring abutment engages the end face of the distance piece 18 which is presented to the end face 19 of the holder when the valve member is in the closed position.

Figure 2:
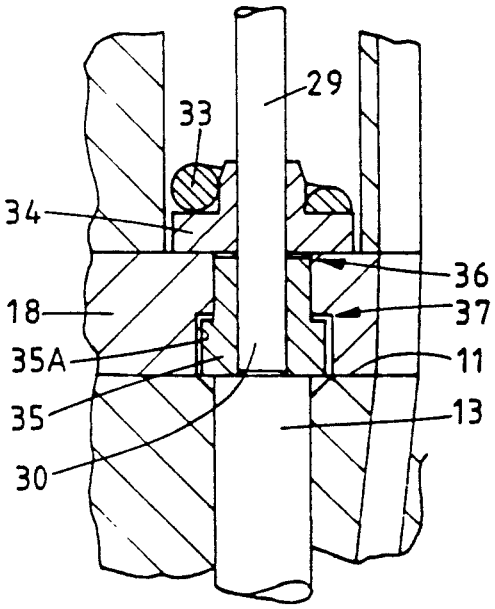
FIG. 2 shows a portion of the nozzle seen in FIG. 1 to an enlarged scale and FIG. 3 is a view similar to FIG. 2 showing a modification.

As more clearly seen in FIGS. 2 and 3, there is located between the end face of the valve member 13 and the abutment 34, a push-piece which is in the form of a flanged sleeve 35, the sleeve being located within a complementary stepped bore 35A formed in the distance piece 18. The wall of the opening in the sleeve 35 guides the movement of the rod 29. It will be noted from FIG. 2 that in the closed position of the valve member 13 as illustrated, there is a small clearance 36 between the end of the sleeve 35 and the abutment 34 and a larger clearance 37 between the flange of the sleeve and the step defined by the bore 35A in the distance piece.

FIG. 2 shows the arrangement of FIG. 1 and in this arrangement the narrower portion of the flanged sleeve 35 is guided for movement in the narrower portion of the bore 35A. It therefor guides the movement of the rod 29 and in turn the spring abutment 34. The working clearance between the sleeve 35 and the narrower portion of the bore 35A is such that fuel which flows along the working clearance between the valve member 13 and the wall of the bore 12 can escape to the vented chamber 25. In the arrangement which is shown in FIG. 3 the sleeve 35 is guided about the extension 30 of the valve member and a clearance exists between the narrower portion of the sleeve and the narrower portion of the bore 35A. In this arrangement therefore it is the valve member 13 which guides the sleeve, the rod 29 and the spring abutment 34.

In operation, when fuel under pressure is supplied to the inlet 22, the fuel pressure acts upon the valve member to generate a force tending to lift the valve member from the seating 16. When the force developed by the fuel under pressure is sufficient to overcome the force exerted by the spring 27, the valve member lifts from the seating by an amount determined by the clearance 36 and fuel flows through the outlet 17 at a restricted rate. As the fuel pressure continues to increase, the force acting on the valve member will increase and eventually the force will become sufficient to move the valve member against the action of both springs and the fuel can flow through the outlet 17 at an increased rate. The maximum extent of movement of the valve member away from the seating is determined by the clearance 37.

In the closed position of the valve member 13 the end face of the valve member which engages the sleeve 35 lies flush with the mounting face 11 and therefore the mounting face and the end face of the valve member can be machined in one operation.

The clearance 36 is critical for the satisfactory operation of the nozzle. In order to set the clearance one end of the sleeve 35 and one end of the distance piece 18 are accurately ground and with the sleeve located in the distance piece the sleeve is raised using a shim and the opposite ends of the sleeve and distance piece ground in the same operation. The thickness of the shim is equal to the desired clearance 36. The clearance 37 can be obtained by normal machining techniques since the precise dimension is not critical.

The nozzle opening pressure is determined by adjusting the thickness of the shim which is located between the spring 27 and the end wall of the chamber 25 and the pressure at which continued movement of the valve member takes place after the first stage of lift, is adjusted by varying the thickness of the shim 32.

I claim:

1. A fuel injection nozzle for supplying fuel to an internal combustion engine comprising a nozzle body defining at one end a mounting face, a blind bore extending inwardly from the mounting face towards the other end of the body, a seating defined in the bore, a valve member slidable in the bore and engagable in its closed position with the seating to prevent flow of fuel through an outlet from a nozzle inlet, the valve member being movable by fuel under pressure supplied to the inlet away from the seating, a nozzle holder, a distance piece interposed between an end face of the holder and said mounting face, means securing the nozzle holder, the distance piece and the nozzle body in assembled relationship, a first spring housed within a chamber defined in the holder, the first spring acting through a rod to urge the valve member into contact with the seating, a second spring housed within the chamber, a spring abutment engaged with one end of the second spring and a push piece located between the valve member and the spring abutment, said valve member being initially moved by the fuel pressure against the action of the first spring to allow a restricted flow of fuel through the outlet and after a predetermined movement, against the action of both springs to allow an increased flow of fuel through the outlet, said push piece comprising a flanged sleeve housed in a stepped bore in the distance piece and in the closed position of the valve member the surface of the valve member which engages said sleeve being flush with said mounting face and the spring abutment engaging the end face of the distance piece which is presented to the nozzle holder whereby the setting of said predetermined movement can be determined by machining at least one of the distance piece and the push piece.

2. A nozzle according to claim 1 in which the narrower portion of the flanged sleeve is presented to the spring abutment and the flange of the sleeve is engagable with the step in the stepped bore to limit the extent of movement of the valve member away from the seating.

3. A nozzle according to claim 1, in which the rod acts directly upon the valve member, the rod extending through and being guided by an opening in the flanged sleeve, and part of the sleeve being guided for movement in the bore in the distance piece.

4. A nozzle according to claim 1, in which the rod acts upon an extension of the valve member, the sleeve being mounted about the extension and serving to guide the movement of the rod.

* * * * *